US011118785B2

(12) United States Patent
Ryon et al.

(10) Patent No.: US 11,118,785 B2
(45) Date of Patent: Sep. 14, 2021

(54) FUEL INJECTORS FOR EXHAUST HEATERS

(71) Applicant: Delavan Inc., West Des Moines, IA (US)

(72) Inventors: Jason A. Ryon, Carlisle, IA (US); Steven J. Myers, Norwalk, IA (US); Philip E. O. Buelow, West Des Moines, IA (US); Lev Alexander Prociw, Johnston, IA (US)

(73) Assignee: Delavan Inc., West Des Moines, IA (US)

( * ) Notice: Subject to any disclaimer, the term of this patent is extended or adjusted under 35 U.S.C. 154(b) by 109 days.

(21) Appl. No.: 16/171,859

(22) Filed: Oct. 26, 2018

(65) Prior Publication Data

US 2020/0132305 A1 Apr. 30, 2020

(51) Int. Cl.

| | |
|---|---|
| ***F01N 3/20*** | (2006.01) |
| ***F23R 3/28*** | (2006.01) |
| ***F23R 3/06*** | (2006.01) |

(52) U.S. Cl.

CPC ..... *F23R 3/283* (2013.01); *F01N 3/2033* (2013.01); *F23R 3/06* (2013.01); *F01N 2240/14* (2013.01)

(58) Field of Classification Search

CPC ..... F01N 3/2033; F01N 13/1855; F01N 2240/14; F01N 2450/26; F23R 3/06; F23R 3/283

See application file for complete search history.

(56) References Cited

U.S. PATENT DOCUMENTS

| | | | | |
|---|---|---|---|---|
| 5,339,630 | A * | 8/1994 | Pettit | F23G 7/065 60/303 |
| 5,417,059 | A * | 5/1995 | Hartel | F01N 3/025 60/276 |
| 5,571,484 | A * | 11/1996 | Pettit | F01N 3/2033 422/173 |
| 6,247,317 | B1 * | 6/2001 | Kostka | F23C 7/002 60/741 |
| 6,318,077 | B1 | 11/2001 | Claypole et al. | |
| 6,863,228 | B2 * | 3/2005 | Mao | B05B 7/08 239/399 |

(Continued)

FOREIGN PATENT DOCUMENTS

| | | |
|---|---|---|
| EP | 3059497 A2 | 8/2016 |
| WO | 2008/062307 | 5/2008 |

OTHER PUBLICATIONS

Extended European Search Report dated Feb. 26, 2020, issued during the prosecution of European Patent Application No. EP 19205034.2.

*Primary Examiner* — Matthew T Largi
(74) *Attorney, Agent, or Firm* — Locke Lord LLP; Joshua L. Jones; Scott D. Wofsy

(57) ABSTRACT

A fuel injector for an exhaust heater includes a cover and an air blast nozzle. The cover has a nozzle seat, a fuel inlet, and an air inlet, the nozzle seat arranged along a flow axis. The air blast nozzle is seated in the nozzle seat and has a unibody. The air blast nozzle unibody is in fluid communication with the fuel inlet and the air inlet arranged along the flow axis to port fuel and air into a combustion volume, e.g., to heat a stream of exhaust gas flowing between an engine and a catalytic reactor by combustion with fuel introduced through the fuel inlet and air introduced through the air inlet.

19 Claims, 7 Drawing Sheets

(56) References Cited

U.S. PATENT DOCUMENTS

| | | | | |
|---|---|---|---|---|
| 7,367,182 | B2 * | 5/2008 | Takahashi | F01N 13/0097 60/286 |
| 8,511,075 | B2 * | 8/2013 | Brown | F01N 3/2033 60/303 |
| 9,328,640 | B2 * | 5/2016 | Iverson | F01N 3/025 |
| 2006/0218925 | A1 * | 10/2006 | Prociw | F23K 5/06 60/739 |
| 2011/0289906 | A1 * | 12/2011 | Morley | F01N 3/035 60/320 |
| 2014/0339339 | A1 * | 11/2014 | Prociw | F23D 11/107 239/406 |
| 2015/0108236 | A1 | 4/2015 | Buelow et al. | |
| 2019/0309949 | A1 * | 10/2019 | Prociw | F23R 3/283 |

* cited by examiner

FUEL INJECTORS FOR EXHAUST HEATERS

BACKGROUND OF THE INVENTION

1. Field of the Invention

The present disclosure relates emissions control systems, and more particularly exhaust heaters for emissions control systems employing catalytic reactors.

2. Description of Related Art

Internal combustion engines commonly include pollution systems to limit engine emissions. For example, catalytic converters are routinely used in pollution control systems to convert toxic and harmful gases and pollutants in exhaust gases from an internal combustion engine into less-toxic pollutants by catalyzing a redox reaction, i.e. an oxidation and a reduction reaction. Since redox reactions can be sensitive to temperature it can be necessary to heat the engine exhaust prior to introduction into the catalytic converter. Heating exhaust gases prior to introduction to the catalytic converter can extend emission control to operation intervals when the catalytic converter is cold, such as during starting and/or in cold weather.

Exhaust heaters can employ heat exchangers, electrical heating elements, or combustors. Heat exchangers, such as those employing a flow of heated coolant from the engine, require that the engine coolant be heated and therefore can be of limited use to limit emissions immediately after starting. Electric heating elements can generally provide heat quickly but complicate the engine electrical system. Combustors typically divert pressurized fuel from the engine fuel system, reducing fuel efficiency or requiring valves and control schemes for selective operation.

Such conventional methods and systems have generally been considered satisfactory for their intended purpose. However, there is still a need in the art for improved exhaust heater nozzles, exhaust heater arrangements, and methods of heating exhaust. The present disclosure provides a solution for this need.

SUMMARY OF THE INVENTION

A fuel injector for an exhaust heater includes a cover and an air blast nozzle. The cover has a nozzle seat, a fuel inlet, and an air inlet, the nozzle seat arranged along a flow axis. The air blast nozzle is seated in the nozzle seat and has a unibody. The air blast nozzle unibody is in fluid communication with the fuel inlet and the air inlet arranged along the flow axis to port fuel and air into a combustion volume, e.g., to heat a stream of exhaust gas flowing between an engine and a catalytic reactor by combustion with fuel introduced through the fuel inlet and air introduced through the air inlet.

In certain embodiments the unibody can include an annular portion and a disk portion. The disk portion can join the annular portion at a radially inner surface of the annular portion. The disk portion can have one or more inner air channels. Each of the inner air channels can have an inlet and an outlet. The outlet can be arranged radially outward of the inlet. The inlet and outlet can be overlapped by the annular portion of the unibody. The annular portion can have a bayonet feature and a shearing lip for atomizing liquid fuel with pressurized air. One or more fuel circuit threads can extend about a radially outer surface of the annular portion.

A sealing ring can extend about the radially outer surface of annular portion arranged axially between the bayonet feature and the fuel circuit threads.

In accordance with certain embodiments, the cover can have an outer air circuit extending through the cover. The outer air circuit can have one or more outer air channels, the outer air channels distributed circumferentially about the air blast nozzle. Each of the outer air channels can have an inlet and an outlet. The outlet can be arranged radially inward of the inlet relative to the air blast nozzle. The cover can have a flame sensor seat radially offset from the air blast nozzle. A flame sensor can be fixed in the flame sensor seat. The cover can have an igniter seat radially offset from the air blast nozzle. An igniter can be fixed in the igniter seat.

It is contemplated that, in accordance with certain embodiments, the cover can define therein a fuel conduit extending radially inward from the fuel inlet to air blast nozzle. The fuel injector can have a two-piece construction. The fuel injector can include the air blast nozzle and the cover. One of the cover and the air blast nozzle can have a female bayonet feature. The other of the cover and the air blast nozzle can have a male bayonet feature. The female bayonet feature and the male bayonet feature can fix the air blast nozzle to the cover.

It is also contemplated that the cover of the fuel injector can be seated on a combustor. A combustor liner can be fixed between the cover and the combustor. The cover can define a fastener pattern. The fastener pattern can be arranged to fix the fuel injector to the combustor with a combustor liner fixed between the cover and the combustor. A low pressure liquid fuel source can be in fluid communication with the fuel inlet. A pressurized air source can be in fluid communication with the air inlet. An exhaust conduit can be spaced apart from the cover to conveying an exhaust flow for heating by fuel provided by the fuel injector. A diesel engine can be connected to the exhaust conduit. A catalytic reactor can be connected to the exhaust conduit and fluidly coupled therethrough to the diesel engine. The fuel injector can be arranged fluidly between the engine and reactor.

An exhaust heater includes a combustor and a fuel injector as described above. The cover has a fastener pattern arranged to fix the fuel injector to the combustor. A combustor liner is fixed between the cover the combustor. A diesel engine is connected to the exhaust conduit. A catalytic reactor is connected to the exhaust conduit and is fluidly coupled therethrough with the diesel engine, the fuel injector arranged fluidly between the diesel engine and catalytic reactor.

In certain embodiments, the fuel injector can have a two-piece construction consisting of the air blast nozzle and the cover, one of the cover and the air blast nozzle can have a female bayonet feature, the other of the cover and the air blast nozzle can have a male bayonet feature, and the female bayonet feature and the male bayonet feature fix the air blast nozzle to the cover.

In accordance with certain embodiments, the unibody can have an annular portion and a disk portion with inner air channels. The disk portion can join the annular portion at a radially inner surface of the annular portion. Each of the inner air channels can have an inlet and an outlet, the outlet of each inner air channel arranged radially outward of the inlet of each inner air channel, the inlet and outlet of each inner air channel axially overlapped by the annular portion of the unibody. The annular portion can have a male bayonet feature and shearing lip for atomizing liquid fuel, one or more fuel circuit threads extending about a radially outer surface of the annular portion, and a sealing ring extending about the radially outer surface of annular portion arranged axially between the male bayonet feature.

A method of making a fuel injector for an exhaust heater includes seating an o-ring about an air blast nozzle and inserting the air blast nozzle into a nozzle seat defined within a combustor cover such that the o-ring is disposed between the air blast nozzle and the combustor cover. The air blast nozzle is rotated about a flow axis defined by the combustor cover to compress the o-ring and lock a male bayonet mount feature within a female bayonet feature. The air blast nozzle is then fixed in rotation relative to the combustor cover.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
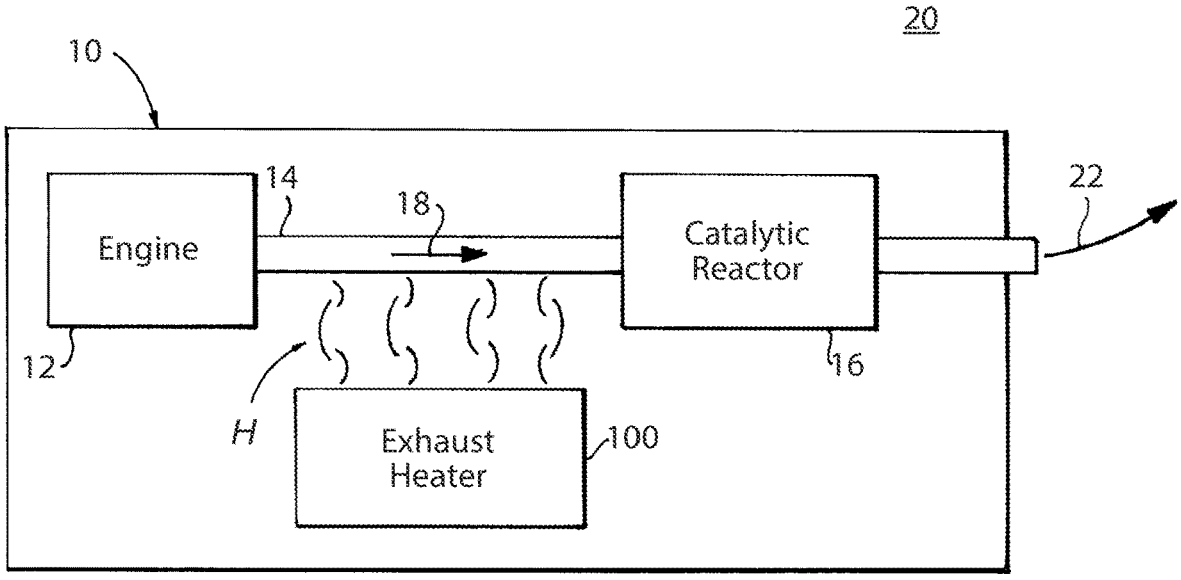
FIG. 1 is a schematic view of an exemplary embodiment of a vehicle constructed in accordance with the present disclosure, showing an exhaust heater with a fuel injector.

Reference will now be made to the drawings wherein like reference numerals identify similar structural features or aspects of the subject disclosure. For purposes of explanation and illustration, and not limitation, a partial view of an exemplary embodiment of an exhaust heater with a fuel injector in accordance with the disclosure is shown in FIG. 1 and is designated generally by reference character 100. Other embodiments of exhaust heaters, fuel injectors for exhaust heaters, and methods of making fuel injectors for exhaust heaters in accordance with the disclosure, or aspects thereof, are provided in FIGS. 2-10, as will be described. The systems and methods described herein can be used for heating combustion products generated by diesel engines for reduction in catalytic reactors when the catalytic reactor may otherwise be unable to support reduction, such as during cold weather and/or during engine starting, though the present disclosure is not limited to cold weather operation and/or starting or to diesel engines in general.

Referring to FIG. 1, a vehicle 10 is shown. Vehicle 10 includes an engine 12, an exhaust conduit 14, a catalytic reactor 16, and an exhaust heater 100. Engine 12 is configured and adapted for providing motive power to vehicle 10 and can be, in certain embodiments, a diesel engine for an automotive application. Exhaust conduit 14 connects engine 12 to catalytic reactor 16 to convey thereto combustion products 18 generated by engine 12 to catalytic reactor 16 for reduction prior to emission into the ambient environment 20 as reduced combustion products 22. Catalytic reactor 16 is configured and adapted for supporting a redox reaction of combustion products 18 communicated thereto by engine 12 through exhaust conduit 14. Exhaust heater 100 is configured and adapted to communicate heat H to combustion products 18 as combustion products 18 flow between engine 12 and catalytic reactor 16 to promote the reduction of combustion products 18 by catalytic reactor 16. While described herein in the context of a diesel engine it is to be understood and appreciated that other types of engines can benefit from the present disclosure, such gas-type internal combustion engines by way of non-limiting example.

As will be appreciated by those of skill in the art in view of the present disclosure, the efficiency of catalytic reactor 16 can be affected by temperature of combustion products 18 arriving at catalytic reactor 16. In particular, when the temperature of combustion products 18 is relatively low catalytic reactor 16 can have difficulty initiating and/or sustaining the redox reaction necessary to render combustion products 18 less toxic than as emitted from engine 12. This can be the case, for example, during engine operation in cold weather and/or during engine starting. To promote the redox reaction in catalytic reactor 16 when combustion products 18 are relatively cool exhaust heater 100 is in thermal communication with exhaust conduit 14 to heat combustion products 18 prior to entry to catalytic reactor 16.

Figure 2:
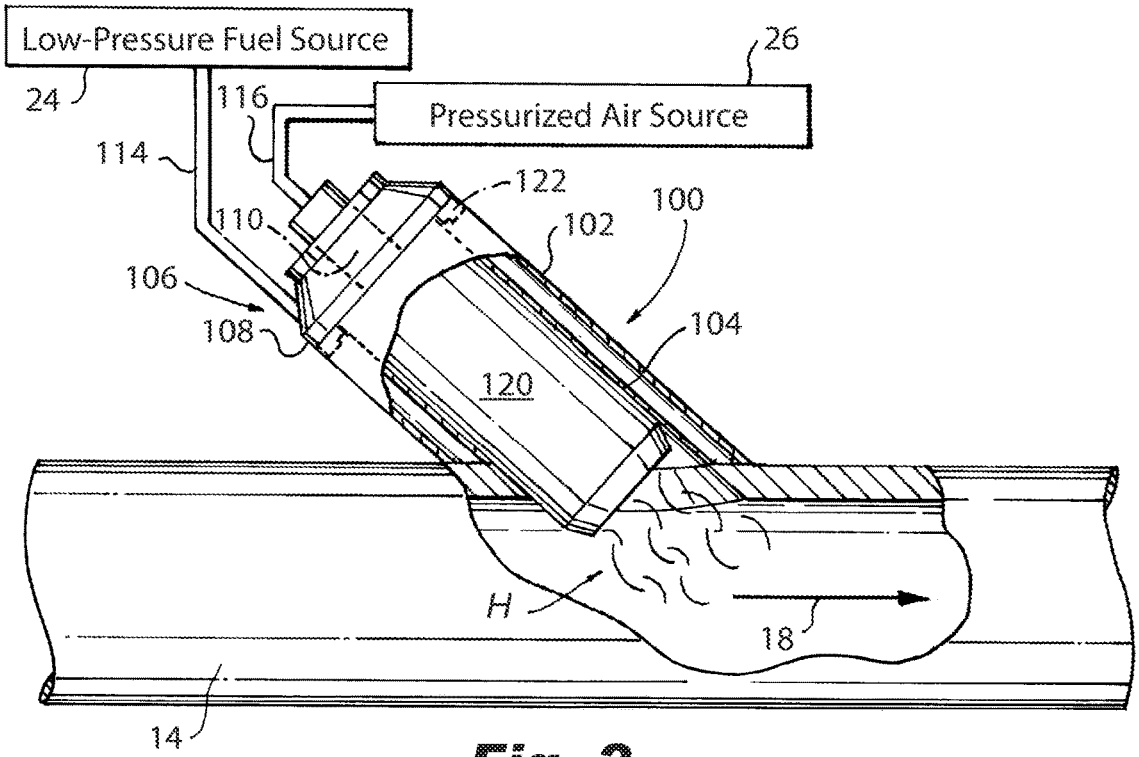
FIG. 2 is cross-sectional view of the exhaust heater of FIG. 1, showing the fuel injector fastened to a combustor with a combustor liner fixed between the cover and the combustor.

With reference to FIG. 2, exhaust heater 100 is shown. Exhaust heater 100 includes a combustor 102 defining a combustion chamber therein with a combustor liner 104 and a fuel injector 106. Fuel injector 106 includes a combustor cover 108 and an air blast nozzle 110. Combustor cover 108 defines within its body a nozzle seat 112 (shown in FIG. 4) and has a fuel inlet 114 and an air inlet 116. Nozzle seat 112 is arranged along a flow axis 128. Air blast nozzle 110 is seated within nozzle seat 112 and has a unibody 152 (shown in FIG. 5). Unibody 152 is in fluid communication with fuel inlet 114 and air inlet 116 to generate heat H (shown in FIG. 1) using a flow of low pressure fuel, introduced through fuel inlet 114, and a flow of pressurized air, introduced at air inlet 116. Heat H generated by exhaust heater 100 is communicated to combustion products 18 traversing exhaust conduit 14.

Combustor 102 connects fuel injector 106 to exhaust conduit 14 and defines within its interior a combustion volume 120. Combustor liner 104 is fixed within combustor 102 and bounds combustion volume 120. In the illustrated exemplary embodiment, combustor liner 104 is arranged axially between combustor cover 108 and exhaust conduit 14 with a lip portion 122 compressively seated between combustor 102 and combustor cover 108, combustor liner 104 thereby being fixed within combustor 102 by combustor cover 108. A plurality of fasteners 124 (shown in FIG. 10), e.g., bolts or threaded studs, threadably secure combustor cover 108 to combustor 102 to removably fix fuel injector 106 to combustor 102 with combustor liner 104. As will be appreciated by those of skill in the art in view of the present disclosure, fasteners 124 allow for removal for cleaning and/or replacement of combustor liner 104 and/or fuel injector 106 in the event that removal becomes necessary during service.

Fuel inlet 114 is in fluid communication with a low-pressure fuel source 24. Low-pressure fuel source 24 can be, for example, a fuel source for vehicle 10 (shown in FIG. 1), arranged to provide a flow of fuel to fuel injector 106. Air inlet 116 is in fluid communication with a pressurized air source 26, such as a compressor or an air tank, and is arranged to provide a flow of pressurized air to fuel injector 106. Use of pressurized air can limit the amount of fuel used by exhaust heater 100 as low pressure fuel provided by low-pressure fuel source 24 can be atomized by the flow of high pressure air using an air blast technique. Use of pressurized air can also allow exhaust heater 100 to operate when vehicle fuel pump is shutdown, exhaust heater thereby being ready upon starting to communicate heat H to combustion products 18.

Figure 3:
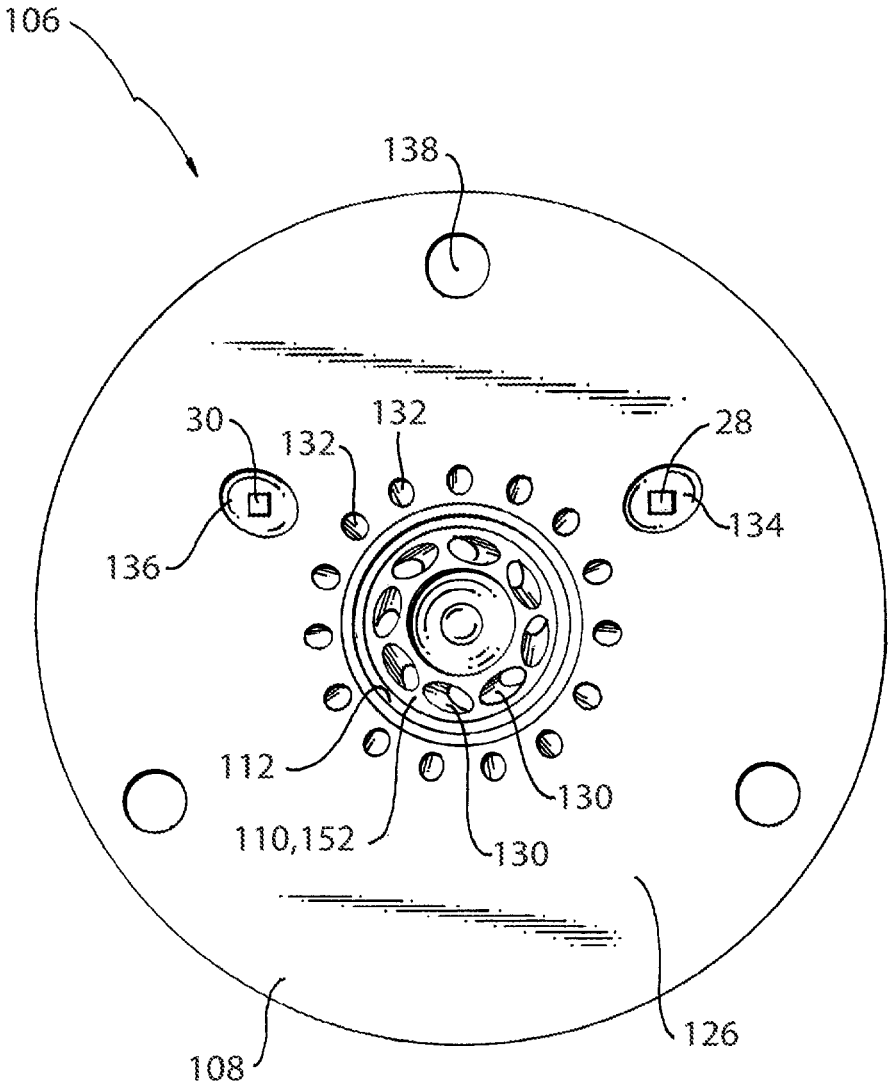
FIG. 3 is a plan view of the fuel injector of FIG. 1, showing an igniter seat and a flame sensor seat with a fastener pattern arranged about an air blast nozzle.

With reference to FIG. 3, fuel injector 106 is shown. Fuel injector 106 includes combustor cover 108 and air blast nozzle 110. Combustor cover 108 has a combustor face 126 which bounds combustion volume 120 (shown in FIG. 3) and defines nozzle seat 112. Nozzle seat 112 extends about a flow axis 128 (identified in FIG. 4) of fuel injector 106 and supports therein air blast nozzle 110. Air blast nozzle defines one or more inner air circuit outlets 130, which are distributed about flow axis 128 at radial locations between flow axis 128 and nozzle seat 112.

Combustor cover 108 defines a one or more outer air circuit outlets 132, an igniter seat 134, a flame sensor seat 136, and a fastener pattern 138. Fastener pattern 138 is located about a radially outer periphery of combustor cover 108. The plurality of outer air circuit outlets 132 are arranged about nozzle seat 112 radially inward of fastener pattern 138. Flame sensor seat 136 and igniter seat 134 are located on combustor face 126 at radial locations between the plurality of outer air circuit outlets 132 and fastener pattern 138, respectively, igniter seat 134 and flame sensor seat 136 located on opposite sides of nozzle seat 112. Igniter seat 134 is configured and adapted to seat thereon an igniter 28. Flame sensor seat 136 is configured and adapted to seat thereon a flame sensor 30. In the illustrated exemplary embodiment a single flame sensor 30 and a single igniter 28 are seated on combustor face 126, simplifying the arrangement of fuel injector 106. In certain embodiments fuel injector 106 can have more than one igniter and/or more than one flame sensor, as suitable for an intended application. It is also contemplated that the flame sensor 30 and igniter 28 can be combined into a single unit.

Figure 4:
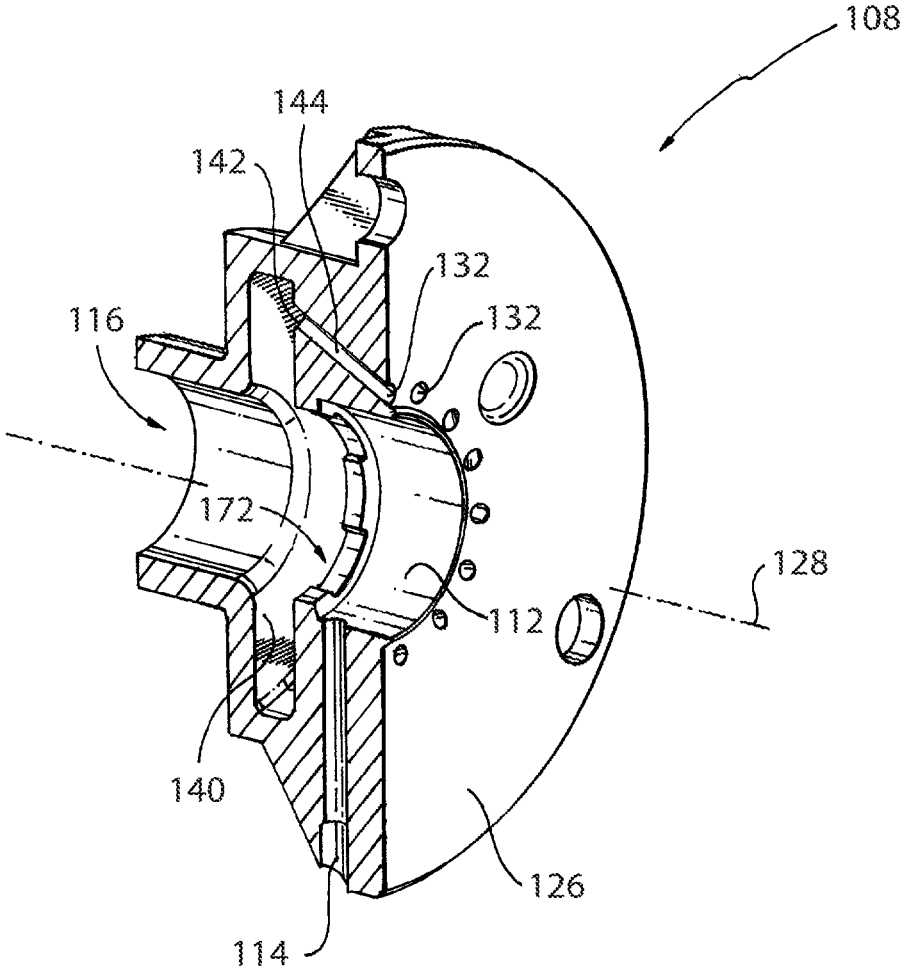
FIG. 4 is a cross-sectional view of the combustor cover of the fuel injector shown in FIG. 1, showing the nozzle seat and outer air channel air passages.

With reference to FIG. 4, combustor cover 108 is shown in cross-section. Air inlet 116 and nozzle seat 112 are each arranged along flow axis 128 with an air supply chamber 140 defined downstream of air inlet 116 and upstream of nozzle seat 112. Air supply chamber 140 extends radially from flow axis 128 to fluidly couple air inlet 116 with each of one or more outer air circuit inlets 142 (one shown in FIG. 4). The one or more outer air circuit inlets 142 are in fluid communication the one or more outer air circuit outlets 132 through outer air channels 144, each outer air channel 144 extending obliquely through combustor cover 108 to provide flows of outer air circuit air directed toward flow axis 128. Each of the one or more outer air circuit inlets 142 is arranged radially outward of each of the one or more outer air circuit outlets 132. In certain embodiments each of the outer air channels 144 has a circumferential component, the respective outer air channel 144 defining a helical path segment about flow axis 128.

Fuel inlet 114 is located at a radially outer periphery of combustor cover 108 and extends radially inward to nozzle seat 112. At the radially inner end, fuel inlet 114 terminates at nozzle seat 112, where fuel inlet 114 fluidly connects to a fuel circuit 146 defined between helical threads 148 (shown in FIG. 5) for providing a flow a fuel to a shearing lip 150 (shown in FIG. 5) extending about air blast nozzle 110.

Figure 5:
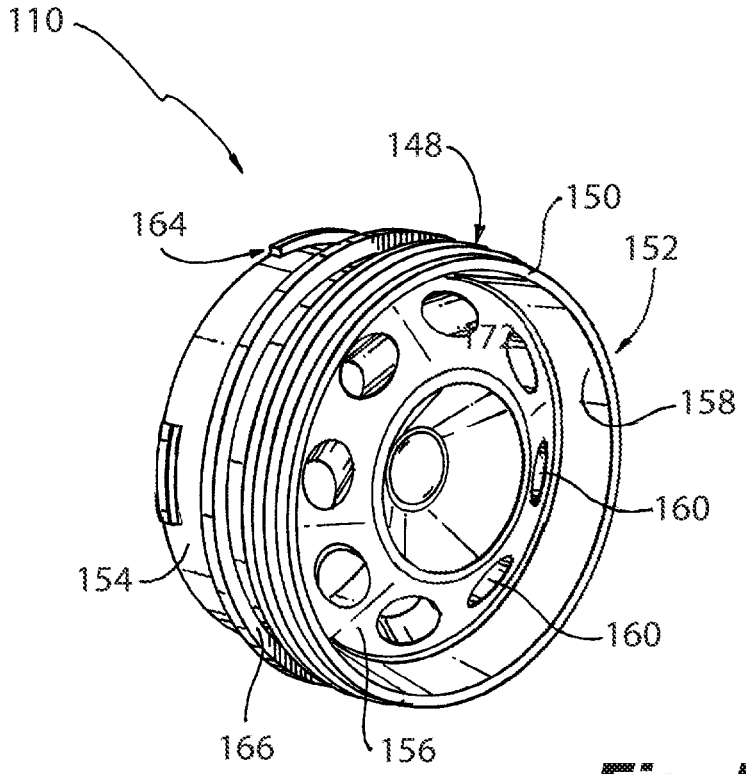
FIGS. 5 and 6 are perspective and cross-sectional views of the air blast nozzle of the fuel injector of FIG. 1, showing bayonet features and the fuel circuit of the air blast nozzle.
Figure 6:
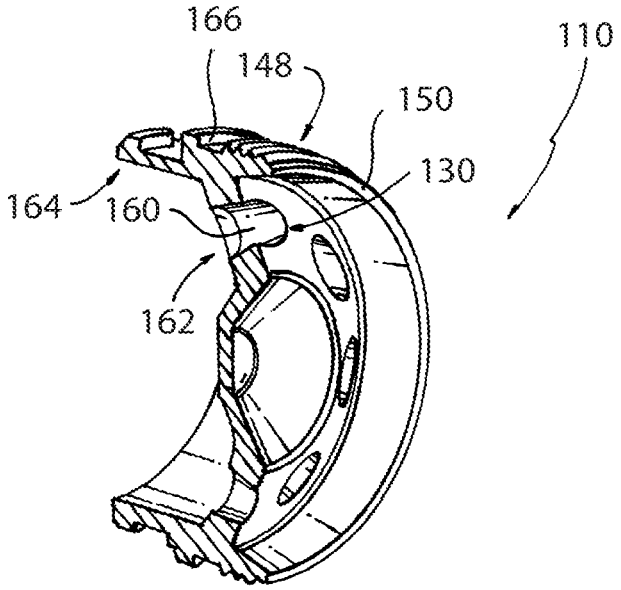

Referring to FIGS. 5 and 6, air blast nozzle 110 is shown. Air blast nozzle 110 has a unibody 152 of one-piece construction with an annular portion 154 and disk portion 156. Disk portion 156 joins annular portion 154 at a radially inner surface 158 and defines one or more inner air channels 160. Each inner air channel 160 in turn extends between an inner air circuit inlet 162 defined in disk portion 156 and inner air circuit outlet 130, also defined in disk portion 156. Each of the inner air circuit inlets 162 are arranged radially inward of the inner air circuit outlets 130 such that air issues from the inner air circuit outlets 130 in a direction oblique and radially outward relative to flow axis 128 (shown in FIG. 4), in the direction of shearing lip 150. In certain embodiments, each of the inner air channels 160 has a circumferential component, the respective inner air channel 160 defining a helical path segment about flow axis 128. It is contemplated that inner air channels 160 be drilled, reducing cost of air blast nozzle 110.

Annular portion 154 has a plurality of bayonet features 164, a sealing ring 166, and a plurality of fuel circuit threads 148 arranged axially on the radially outer surface of annular portion 154. Fuel circuit threads 148 are arranged immediately upstream of shearing lip 150 to define, in cooperation with nozzle seat 112, a fuel circuit extending about the radially outer surface of disk portion 156 bounded by fuel circuit threads 148 and nozzle seat 112. Sealing ring 166 extends about the radially outer surface of annular portion 154 and is arranged to compress an o-ring 168 (shown in FIG. 7). Bayonet features 164 are arranged upstream of sealing ring 166, on a side of sealing ring axially opposite fuel circuit threads 148, and are configured and adapted to engage corresponding bayonet features 172 (shown in FIG. 4) defined within combustor cover 108 and arranged about flow axis 128. As will be appreciated by those of skill in the art in view of the present disclosure, bayonet features 164 and corresponding bayonet features 172 can simplify the assembly of fuel injector 106 by reducing (or eliminating entirely) the need for fasteners to fix air blast nozzle 110 to combustor cover 108. In the illustrated exemplary embodiment bayonet, features 164 are male bayonet features and bayonet features 172 are female bayonet features. This is for illustration purposes only and it is to be understood and appreciated that male bayonet features can be arranged in combustor cover 108 and female bayonet features arrange on air blast nozzle 110, as suitable for an intended application.

Figure 7:
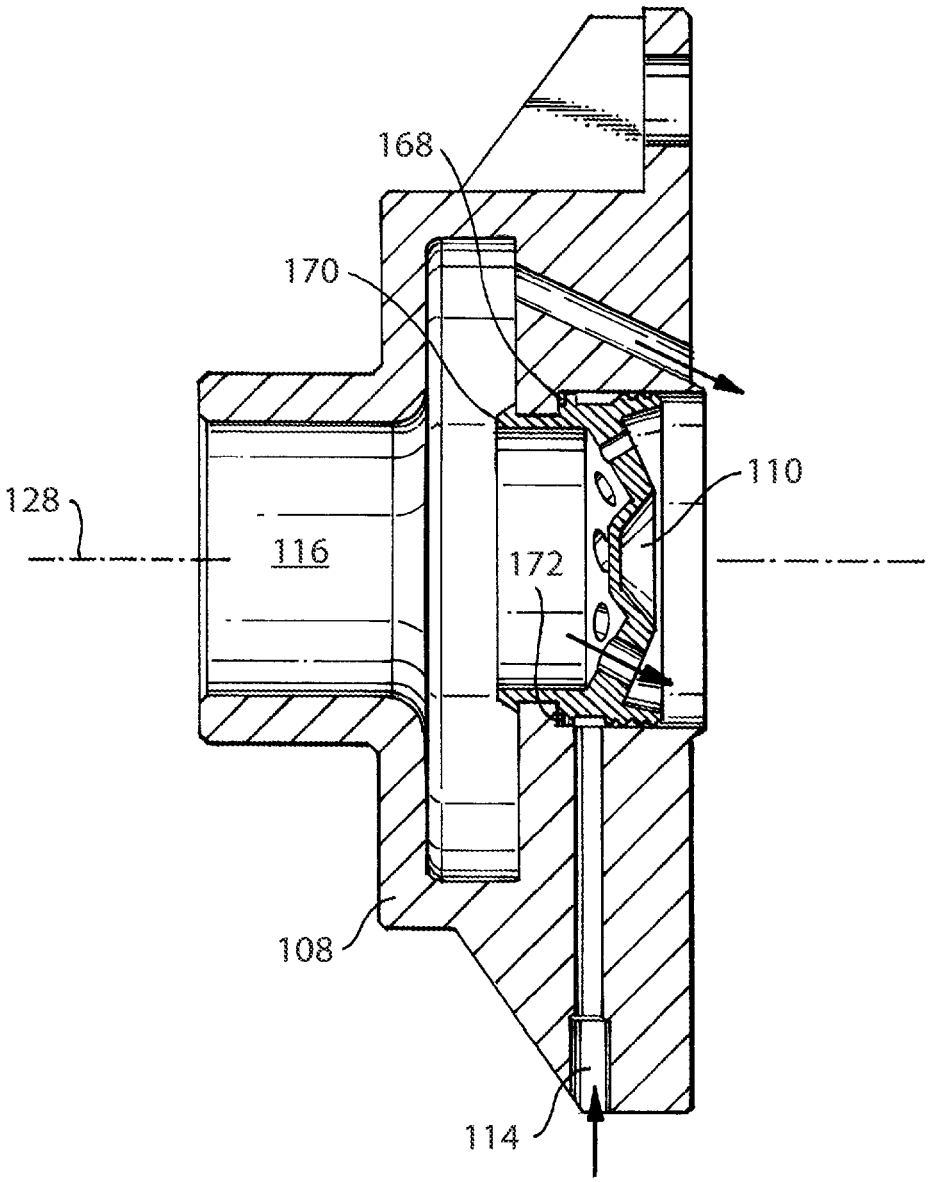
FIG. 7 is a cross-sectional view of the air blast nozzle of the fuel injector illustrated in FIG. 1, showing air channels of the inner aircraft and the shearing lip of the air blast nozzle.

With reference to FIG. 7, fuel injector 106 is shown. Air blast nozzle 110 is seated in combustor cover 108 along flow axis 128 such that air entering air inlet 116 is provided to both outer air channels 144 and inner air channels 160 (as shown in FIGS. 4 and 6). Air flowing through outer air channels 144 exits combustor cover 108 at an angle oblique relative to flow axis 128 and directed radially toward flow axis 128. Air flowing through inner air channels 160 similarly flows through inner air channels 160 and exits combustor cover 108 at an angle oblique relative to flow axis 128 and directed radially outward from flow axis 128. The air flows cooperate to atomize a flow of low pressure fuel arriving at shearing lip 150 (shown in FIG. 5) for combusting within exhaust heater 100 (shown in FIG. 1) to heat combustion products 18 flowing through exhaust conduit 14 (shown in FIG. 1) prior to arriving at catalytic reactor 16 (shown in FIG. 1). As will be appreciated, generating heat H (shown in FIG. 1) using air blast nozzle 110 can limit the amount of fuel required to generate the heat as, being supplied fuel at low pressure, low flow rates can be employed. Further, heat H can be generated when the engine itself is shutdown, such as by using a flow of pressurized air available from a pressurized air system, such as from a compressed air brake system on a vehicle.

Figure 8:
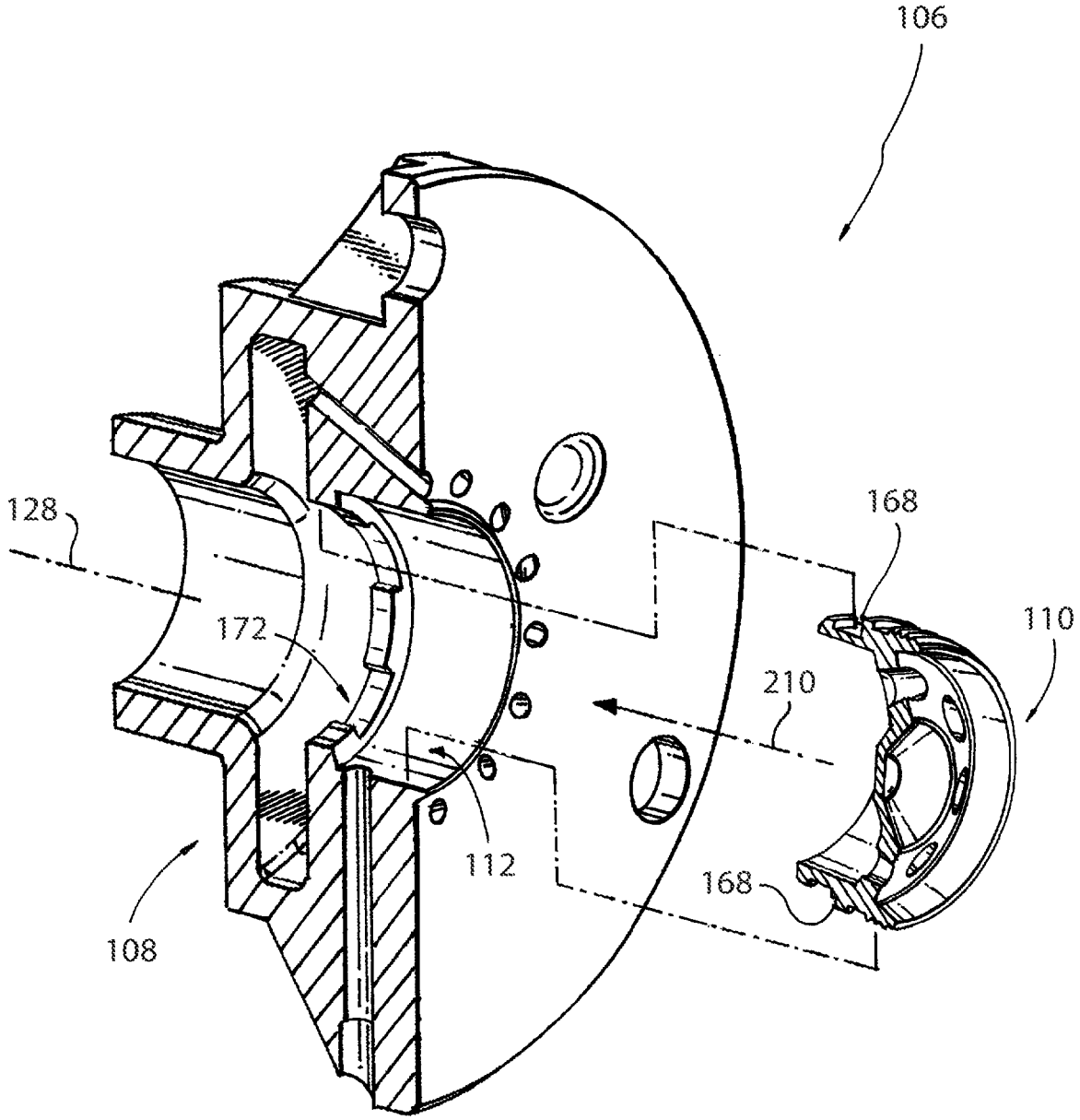
FIGS. 8-10 are perspective views showing a method of making a fuel injector for the exhaust heater of FIG. 1, showing an o-ring being seated on an air blast nozzle, the air blast nozzle being seated in a combustor cover and rotated to compress the o-ring, and the air blast nozzle staked or welded to fix the air blast nozzle in rotation relative to the combustor cover, respectively.
Figure 9:
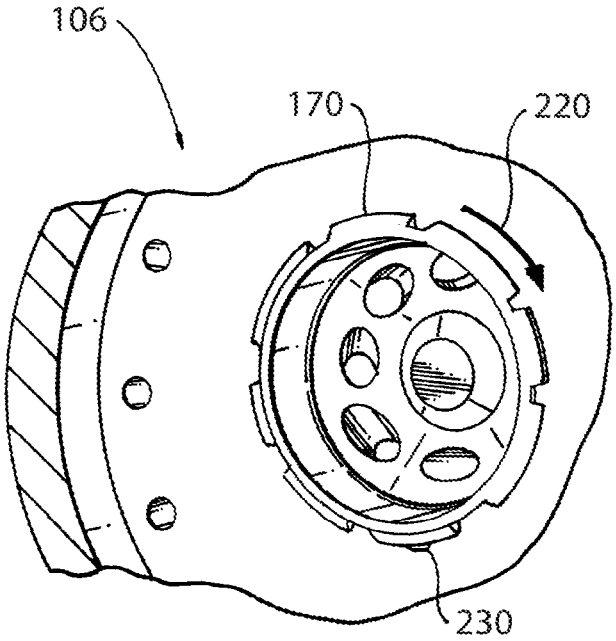
Figure 10:
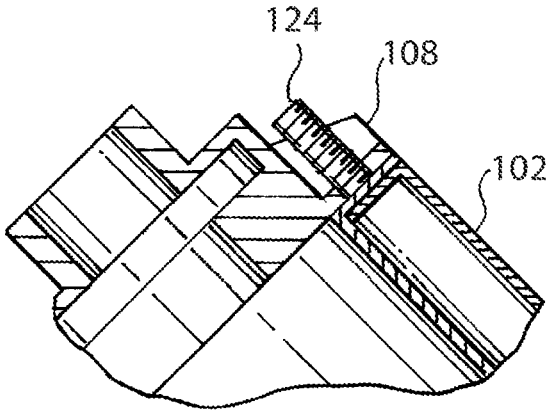

With reference to FIGS. 8-10, a method of making a fuel injector, e.g., fuel injector 106 (shown in FIG. 2), is shown. As shown in FIG. 8, o-ring 168 is seated about air blast nozzle 110. Air blast nozzle 110 is then inserted into combustor cover 108 and into nozzle seat 112, as shown with arrow 210. Air blast nozzle 110 is then rotated about flow axis 128, as shown in FIG. 9 with arrow 220. It is contemplated that rotation of air blast nozzle 110 about flow axis 128 compress o-ring 168, such as by operation of a ramp defined on either (or both) of male bayonet feature 170 (shown in FIG. 9) and female bayonet feature 172 (shown in FIG. 8). Once rotated, air blast nozzle 110 is fixed in rotation relative to combustor cover 108, such as by emplacement of a tack weld 230 or by deforming a surface to raise or dent material thus fixing rotation. Thereafter, as shown in FIG. 10, fuel injector 106 is fixed to combustor 102 by fastening fuel injector 106 to combustor 102 with one or more fasteners 124 or other suitable method of attachment such as welding or clamping.

The methods and systems of the present disclosure, as described above and shown in the drawings, provide for fuel injectors, exhaust heaters, and methods of making exhaust heaters with superior properties including two-piece construction and simplified assembly. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A fuel injector for an exhaust heater, comprising:

a combustor cover extending about a nozzle seat with a fuel inlet and an air inlet, the nozzle seat arranged along a flow axis, wherein a bayonet feature, o-ring, seal ring, and fuel circuit thread within the nozzle seat in that axial order; and an air blast nozzle having a unibody supported in the nozzle seat, the air blast nozzle unibody in fluid communication with the fuel inlet and the air inlet and arranged along the flow axis to port fuel and air into a combustion volume.

2. The fuel injector as recited in claim 1, wherein the fuel injector has a two-piece construction consisting of the air blast nozzle and the combustor cover.

3. The fuel injector as recited in claim 1, wherein one of the combustor cover and the air blast nozzle has a female bayonet feature, wherein the other of the combustor cover and the air blast nozzle has a male bayonet feature, wherein the female bayonet feature and the male bayonet feature fix the air blast nozzle to the combustor cover.

4. The fuel injector as recited in claim 1, wherein the cover has an outer air circuit extending therethrough comprising one or more outer air channels, the outer air channels distributed circumferentially about the air blast nozzle.

5. The fuel injector as recited in claim 4, wherein each of the outer air channels has an inlet and an outlet, the outlet arranged radially inward of the inlet relative to the air blast nozzle.

6. The fuel injector as recited in claim 1, wherein the cover has a flame sensor seat and an igniter seat radially offset from the air blast nozzle.

7. The fuel injector as recited in claim 6, further comprising:

an igniter fixed in the igniter seat; and a flame sensor fixed in the flame sensor seat.

8. The fuel injector as recited in claim 1, wherein the cover defines therein a fuel conduit extending radially inward from the fuel inlet to the air blast nozzle.

9. The fuel injector as recited in claim 1, wherein the cover defines a fastener pattern arranged to fix the fuel injector to a combustor with a combustor liner fixed between the cover and the combustor.

10. The fuel injector as recited in claim 1, further comprising:

a combustor; and a combustor liner fixed between the combustor cover and the combustor.

11. The fuel injector as recited in claim 1, wherein the unibody includes:

an annular portion; and a disk portion with one or more inner air channels, the disk portion joining the annular portion at a radially inner surface of the annular portion.

12. The fuel injector as recited in claim 11, wherein each of the inner air channels has an inlet and an outlet, the outlet of each inner air channel arranged radially outward of the inlet of each inner air channel, the inlet and outlet of each inner air channel axially overlapped by the annular portion of the unibody.

13. The fuel injector as recited in claim 11, wherein the annular portion defines:

a bayonet feature and shearing lip for atomizing liquid fuel using a pressurized air flow;

one or more fuel circuit threads extending about a radially outer surface of the annular portion; and a sealing ring extending about the radially outer surface of annular portion arranged axially between the one or more of fuel circuit threads and the bayonet feature.

14. The fuel injector as recited in claim 1, further comprising:

a low pressure liquid fuel source in fluid communication with the fuel inlet; and a pressurized air source in fluid communication with the air inlet.

15. The fuel injector as recited in claim 1, further comprising an exhaust conduit spaced apart from the cover for conveying exhaust heated by fuel provided by the fuel injector.

16. The fuel injector as recited in claim 15, further comprising:

a diesel engine connected to the exhaust conduit; and a catalytic reactor connected to the exhaust conduit and in fluid communication therethrough with the diesel engine, the fuel injector arranged fluidly between the engine and the catalytic reactor.

17. An exhaust heater, comprising:

a combustor;

the fuel injector as recited in claim 1, wherein the combustor cover defines a fastener pattern arranged to fix the fuel injector to the combustor;

a combustor liner fixed between the cover and the combustor;

a diesel engine connected to the exhaust conduit; and a catalytic reactor connected to the exhaust conduit and fluidly coupled therethrough with the diesel engine, the fuel injector arranged fluidly between the diesel engine and the catalytic reactor.

18. The exhaust heater as recited in claim 17, wherein the fuel injector has a two-piece construction consisting of the air blast nozzle and the cover, wherein one of the cover and the air blast nozzle has a female bayonet feature, wherein the other of the cover and the air blast nozzle has a male bayonet feature, wherein the female bayonet feature and the male bayonet feature fix the air blast nozzle to the cover.

19. The exhaust heater as recited in claim 17, wherein the unibody includes:

an annular portion; and a disk portion with one or more inner air channels, the disk portion joining the annular portion at a radially inner surface of the annular portion;

wherein each of the one or more inner air channels has an inlet and an outlet, the outlet of each inner air channel arranged radially outward of the inlet of each inner air channel, the inlet and outlet of each inner air channel axially overlapped by the annular portion of the unibody; and wherein the annular portion defines:

a bayonet feature and shearing lip for atomizing liquid fuel;

one or more fuel circuit threads extending about a radially outer surface of the annular portion; and a sealing ring extending about the radially outer surface of annular portion arranged axially between the bayonet feature.

* * * * *